United States Patent [19]

Kanao

[11] 4,106,439

[45] Aug. 15, 1978

[54] INTERNAL COMBUSTION ENGINE

[76] Inventor: Mitsuhiro Kanao, No. 2156-14, Yakeyamacho, Kure-shi, Hiroshima-ken, Japan

[21] Appl. No.: 689,892

[22] Filed: May 25, 1976

[30] Foreign Application Priority Data

May 27, 1975 [JP] Japan ..... 50-63636
Aug. 31, 1975 [JP] Japan ..... 50-105755

[51] Int. Cl.[2] ..... F02B 75/02; F01L 3/00

[52] U.S. Cl. ..... 123/75 B; 123/124 R; 123/188 B; 123/DIG. 4

[58] Field of Search ..... 123/26, 32 ST, 47 R, 123/75 R, 75 B, 188 B, DIG. 4, 188 C, 84, 85, 86, 124 R

[56] References Cited

U.S. PATENT DOCUMENTS

| | | | |
|---|---|---|---|
| 1,906,251 | 5/1933 | Dienner | 123/75 R |
| 2,222,730 | 11/1940 | Wallgren | 123/188 B |
| 3,017,872 | 1/1962 | Candelise | 123/75 B |
| 3,315,650 | 4/1967 | Bishop et al. | 123/32 ST |
| 3,973,530 | 8/1976 | Seidel | 123/75 B |
| 4,027,632 | 6/1977 | Wagner | 123/47 R |

FOREIGN PATENT DOCUMENTS

| | | | |
|---|---|---|---|
| 1,056,877 | 5/1959 | Fed. Rep. of Germany | 123/188 B |
| 1,451,949 | 11/1965 | Fed. Rep. of Germany | 123/75 B |

*Primary Examiner*—Charles J. Myhre
*Assistant Examiner*—David D. Reynolds
*Attorney, Agent, or Firm*—William Anthony Drucker

[57] ABSTRACT

In operation of an internal combustion engine, a lamina of air is introduced into the combustion chamber to line the wall thereof, the fuel being admitted into the interior of the lamina of air. The air lamina may be introduced along a cylinder wall through an annular valve which encompasses an inlet and an exhaust valve, and a secondary air flow may take place through the exhaust valve to a position adjacent the exhaust valve. In an alternative, air is admitted annularly about a fuel inlet valve. In a two-stroke engine, air entering the combustion chamber is driven by the incom fuel mixture to form a lamina which lines the wall of the combustion chamber.

3 Claims, 7 Drawing Figures

INTERNAL COMBUSTION ENGINE

BACKGROUND OF THE INVENTION

This invention relates generally to an internal combustion engine, the combustion of which is improved.

In regard to combustion occurring in internal combustion engines, it is known in the prior art for controlling the various exhaust gases to be advantageous to burn $NO_x$ (oxides of nitrogen) using an excess of fuel so as to lower the average temperature, and to burn off CO (carbon monoxide) using a thin fuel/air mixture.

Another method for decreasing the $NO_x$ and CO consists in maintaining the rich mixture at a high temperature of combustion to control $NO_x$, and secondly to accelerate the oxidization reaction by means of additional air to decrease CO when the temperature is somewhat lowered by progress of the combustion.

According to these proposals, there has already been provided a practical engine in which mixtures supplied as lamina flows are generated and burnt in a form of dual combustion. Another engine is also known having a second chamber, its combustion chamber being divided into a main and an auxiliary chamber, the mixtures being injected into the latter.

These engines have problems in regard to (i) quantity of HC which remains unevaporated and (ii) CO generated by the burning of the non-evaporated HC, because the combustion of these engines is intermittent and performed under a limited rise of temperature.

To find a countermeasure which does not lower the thermal efficiency, it is to adopt single combustion.

In the operation which generates HC and CO through combustion, under present conditions, the gases include a great deal of mixture which flows from the part of the top ring of a piston and which composes quenching zones on the inner wall surface of the cylinder and the upper surface of the piston, during the process of combustion. In an exhaust stroke, a large quantity of waste gases flows out immediately after the valve is opened. HC in the gases is mainly drawn off from a quenching zone on the inner wall surface of the cylinder head. In the later portion of the exhaust stroke, HC and CO on the wall surfaces of the piston and cylinder are carried to the valve while it is open, so that extremely enriched waste gases are exhausted.

It is therefore obvious that the avoiding of generation of HC and CO is impossible at present without a countermeasure which prevents formation of quenching zones on those wall surfaces.

OBJECTS OF THE INVENTION

It is accordingly an object of the present invention to provide an internal combustion engine which forms a lamina of air on the whole inner surfaces of the combustion chamber to prevent generation of quenching zones formed by contact of mixtures with the wall surfaces of the combustion chambers, and which controls formation of HC and CO as well as the quenching zones.

It is another object of this invention to provide an internal combustion engine in which a lamina of air is generated on the wall surfaces of the combustion chamber, and suction of mixtures and air can be performed by known valve means.

An embodiment of the invention is hereinafter fully described with reference to the accompanying drawings.

SHORT DESCRIPTION OF THE DRAWINGS

DESCRIPTION OF THE PREFERRED EMBODIMENTS

Figure 1:
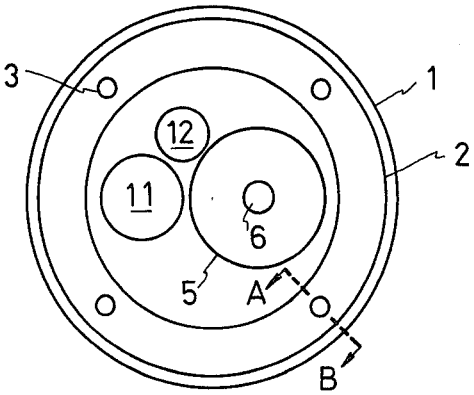
FIG. 1 is a front view showing the parts required by this invention in the cylinder head of a four-cycle engine.
Figure 2:
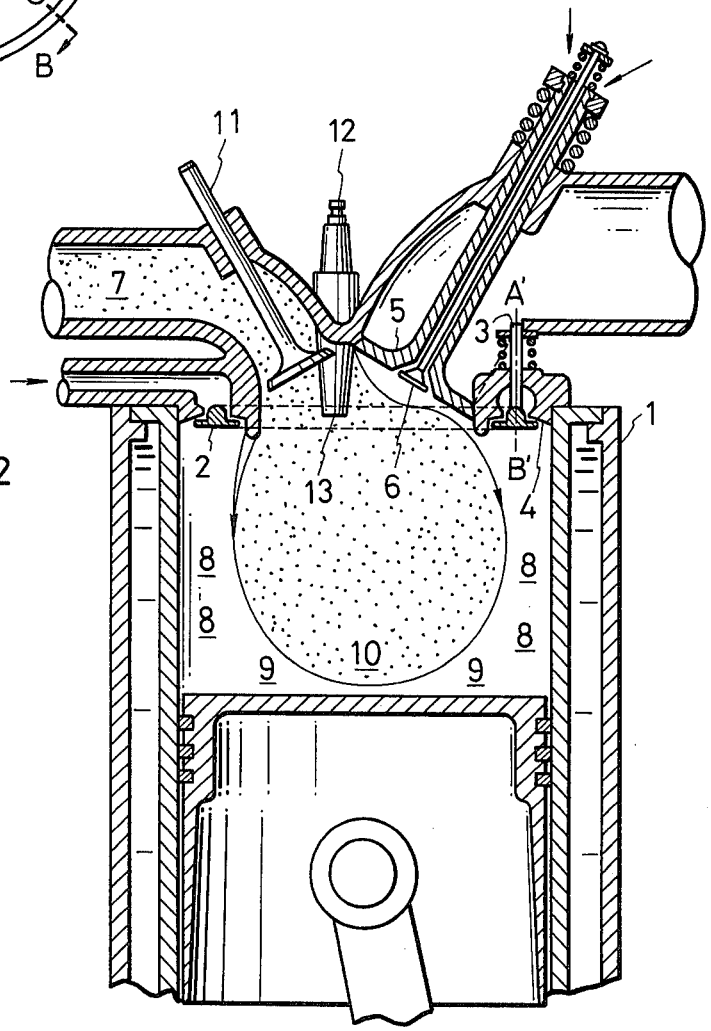
FIG. 2 is a side sectional view of the four-cycle engine according to this invention, in which the position A' - B' corresponds to that of A – B shown in FIG. 1.

In FIGS. 1 and 2, a cylinder head 1 is provided with a ring type valve seat 4 and a ring type air valve 2 having four rod portions 3 which are adapted to the valve seat 4. An exhaust valve 5 is provided with a small-sized air valve 6. During operation of these devices, concentrated mixtures are sucked into the central zone of the cylinder from a fuel supply pipe 7 by the suction stroke, and simultaneously the mixtures are advanced to the upper surface of a piston 9 while generating a spherical air lamina 8 along the wall surface of the cylinder, due to actuation of the ring type air valve 2. The air valve 6 disposed in the exhaust valve 5 also actuates to form a small air lamina 10 adjacent to itself. This entails that the combustion is performed only in air the pressure of which is high. The combustion in the central position of the spherical air lamina 8 is produced at lower temperatures, because the fuel lamina occupying the central position includes less oxygen and nitrogen, and reacts less with air owing to its high concentration. The combustion then develops through average, high and average temperatures and broadens out to the outer lamina, igniting the adjacent portions of the lamina. The flame is finally extinguished by the air lamina which has a low conductivity of heat. The combustion therefore approaches to the ideal one. In this case, it might seem that a problem of ignition position would arise, but it is known that the ignition point has little effect on the combustion in a practical engine.

The air valve 6 shown in FIGS. 1 and 2 as an example must be a self-actuating air suction valve or a forcedly driven air suction valve, according to necessity.

Moreover, in FIGS. 1 and 2, reference number 11 designates a mixture suction valve, 12 denotes a sparking plug, and 13 denotes an ignition plug, the electrodes of which are especially elongated.

Another embodiment of this invention, applied to a two-cycle engine, is now fully described with reference to FIGS. 3 – 5.

In a two-cycle engine in accordance with the present invention, an air ejecting port 22 is provided immediately over a scavenging port (which serves as a supply port in this invention), disposed on the cylinder wall, the air from the ejecting port 22 being blown out upwardly by mixtures ejected from a mixture ejecting port 25 so that an air lamina is produced on the cylinder wall and quenching zones are decreased. Improvement of the effects relating to suction, scavenging and exhaust is also achieved.

Figure 3:
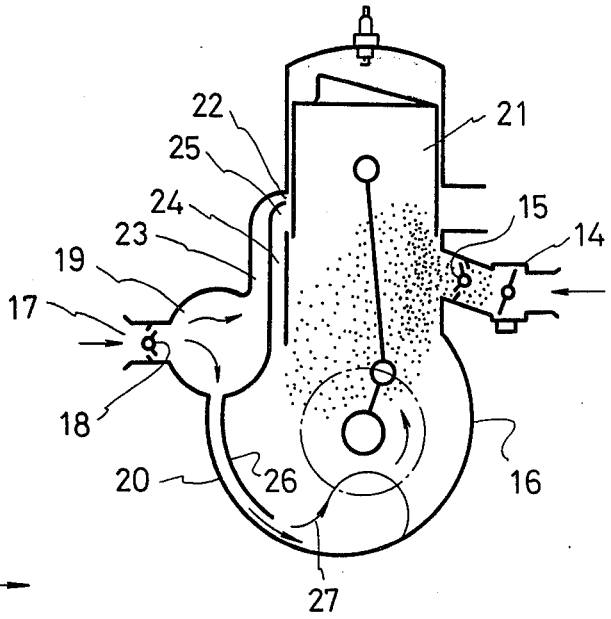
FIGS. 3, 4 and 5 are explanatory views of the present invention applied to a two-cycle engine, FIG. 3 showing a stroke of compression and fuel suction, FIG. 4 showing an exhaust stroke and FIG. 5 showing a side view of the suction stroke.

FIG. 3 shows an example, in which a stroke of compression and suction of fuel including air is illustrated. Enriched mixtures sucked from a carburretor 14 enters a crank case 16 through a free mushroom-type automatic valve 15. Air sucked from an air supply port 17 enters an air chamber 19 through a free mushroom-type automatic valve 18. A part of the air enters a crank case 16 through an associated air running port 20 as shown by arrow 27.

A piston 21 is then lowered to open the air ejecting port 22 in an expansion stroke. In this case, internal pressure caused in the crank case 16 by the lowering motion of the piston 21 presses back a small quantity of air flowing from the port 20 to the crank case 16 into the original port 20, and the compressed air passes through the air chamber 19 and a flue 23, so as to pass as a jet into the cylinder from the ejecting port 22, by which operation the burnt waste gas is exhausted into the atmosphere as shown in FIG. 4.

Next, the further lowered piston 21 opens a mixture ejecting port 25. The mixture in the crank case 16 passes through a supply flue 24 to pass as a jet into the cylinder from the mixture ejecting port 25, and the mixture blows out upwardly the air coming from the air ejecting port 22 at the same time. During this time, waste gases remaining on the cylinder surface are exhausted into the atmosphere as shown in FIG. 5, and an air lamina is accordingly produced on the cylinder wall surface.

Figure 4:
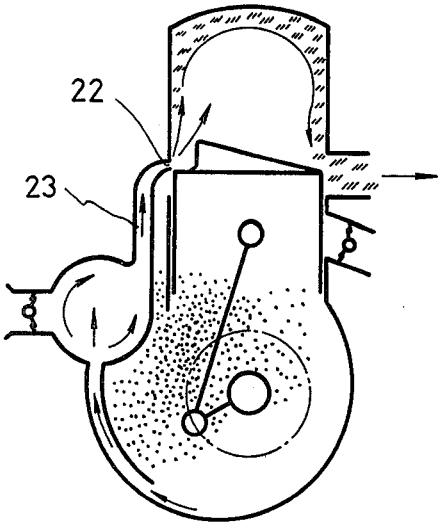
Figure 5:
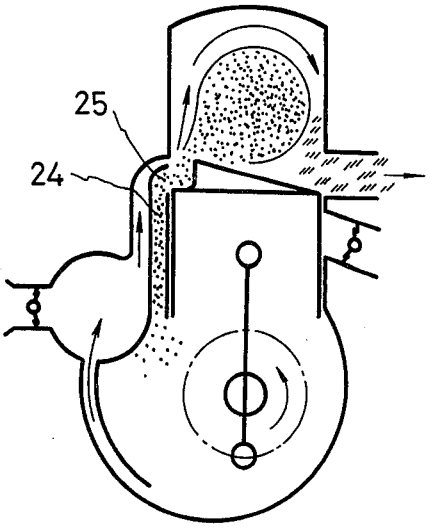

In FIGS. 3 - 5 reference number 26 designates a guide plate which constitutes the associated air running port 20, serving to prevent confluence of air in the air chamber 19.

In a Diesel engine with fuel injection, injecting air cylindrically onto the cylinder wall in a compression stroke is known to be the ideal method.

As described hereinbefore, according to this invention an air lamina is generated on the whole of the surface of the combustion chamber, the combustion is performed with less quenching zones on the inner surface of the cylinder wall as a result, and the amount of HC, CO and NO exhausted is decreased. An internal combustion engine of high thermal efficiency is thus obtainable.

Valve means used in this invention will now be fully described with reference to FIGS. 6 and 7.

Figure 6:
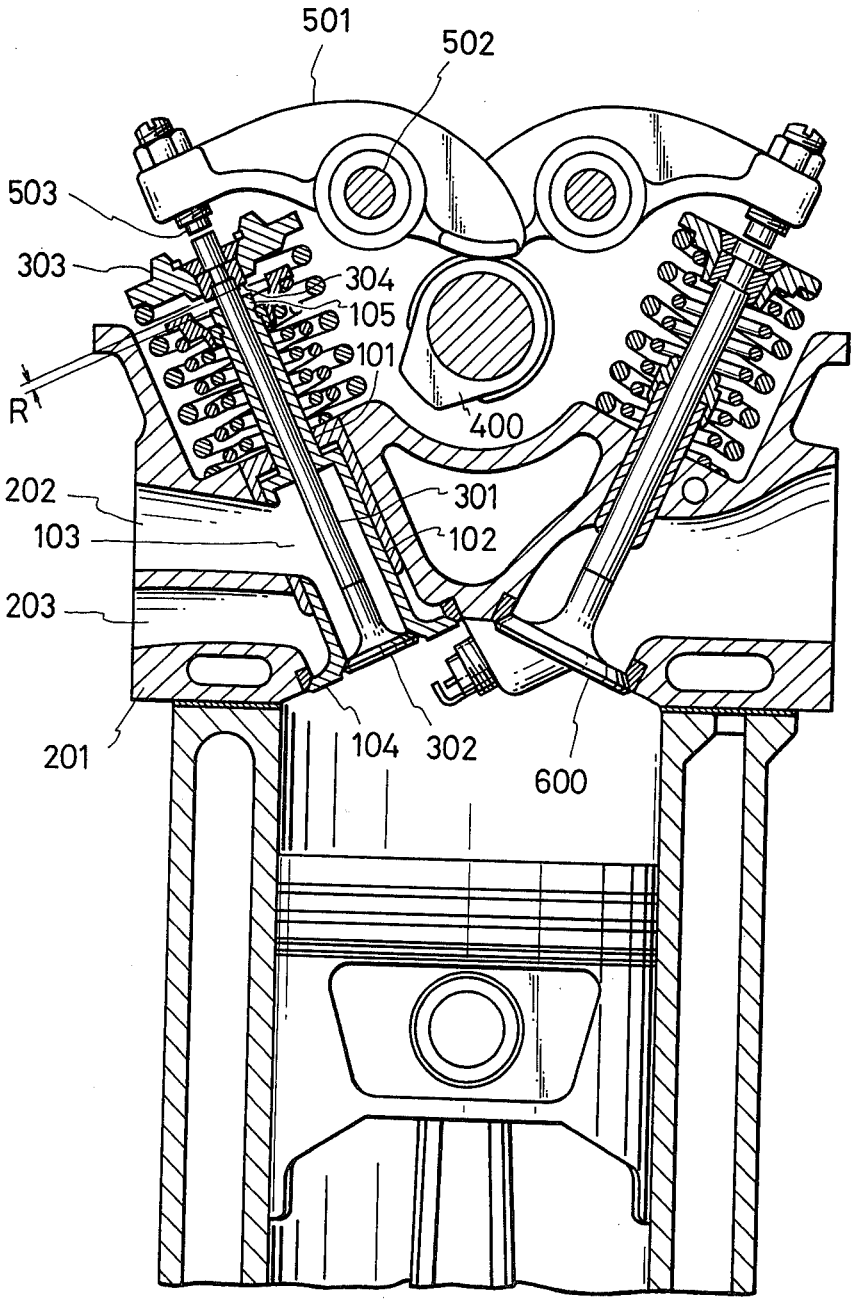
FIG. 6 is a side sectional view of the principal parts of the combustion chamber in an internal combustion engine which is provided with valve means in accordance with the present invention; and, FIG. 7 is a side sectional view of valve means, the valve head of an air valve of the valve means constituting an auxiliary combustion chamber.
Figure 7:
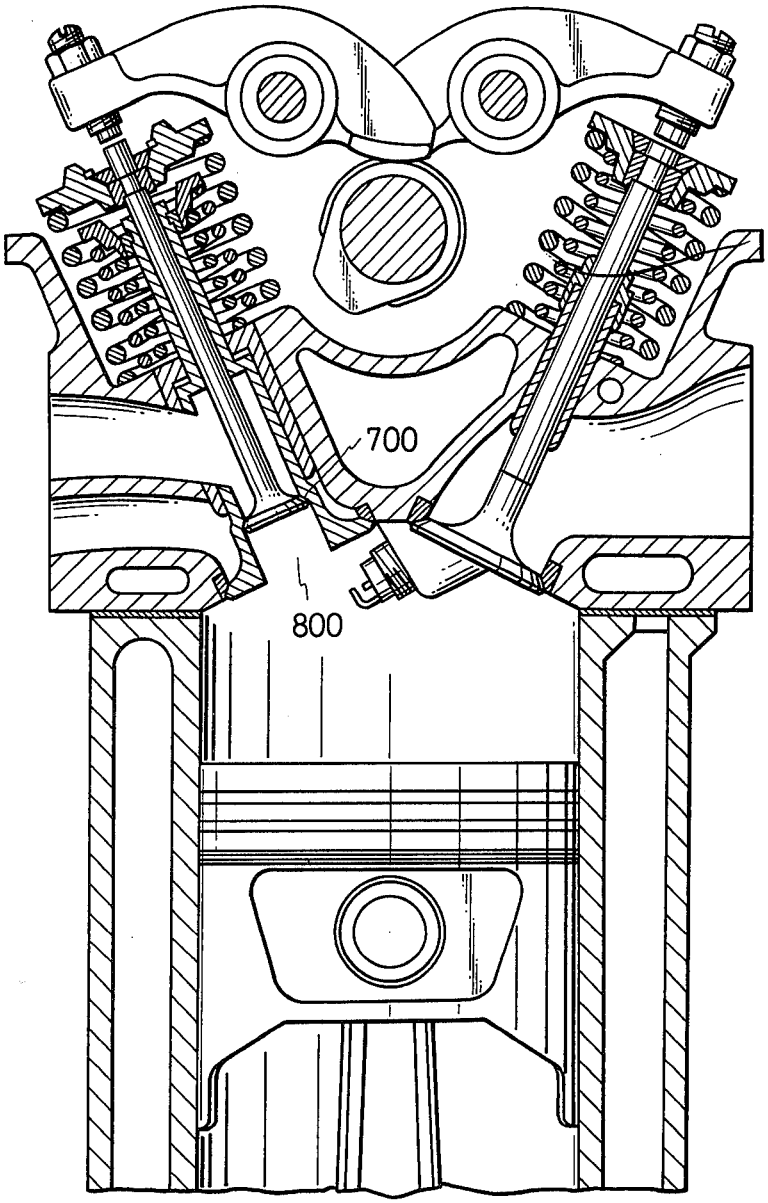

In FIG. 6, a cylinder head has a mixture port 202 in its left half portion. A port providing communication between the port 202 and the inside of the cylinder leads to a lateral hole 103 of an air valve which is composed of a valve rod 101, a cylindrical portion 102, a lateral hole 103, a valve head 104 and a valve rod head 105.

An air port 203 is also positioned adjacent to the mixture port 202 in parallel for sucking air. Adjacent to the central axis of the air valve, there is disposed a small-sized mixture sucking valve which comprises a valve rod 301, a valve head 302, a spring washer 303 and the washer back 304.

In the operation of the above-mentioned structure, a cam 400 is rotated by the running of the engine, and the rotating motion is transmitted to lift an arm 501, and then to the mixture sucking valve as a pressing movement, while its direction is changed by a fulcrum 502. The suction valve therefore travels a distance R which is determined by a tappet adjusting screw 503. As a result of this actuation, the valve head 302 is opened, and the mixture is partially supplied to the central zone of the cylinder. When the valve is shifted over the distance R by the actuation, the washer back 304 presses the valve rod head 105 of the air valve so as to open the valve head 104, and results in air being sucked in. In this case, when air is fed into the cylinder it is sucked directly from the circumference of the air valve into a semi-cylinder in the left half of the cylinder. Also, in the right half of the cylinder, air is sucked through an exhaust valve head 600 and the right-side of the cylinder adjacent to the head 600 onto the cylinder surface, forming a semi-cylindrical lamina if the air valve is positioned at a suitable angle (e.g. 25° from the center to the left). Both of the semi-cylindrical laminae advance to the upper surface of the piston. In this stroke, the suction valve for the mixture is kept open so that a spherical lamina of the mixture is produced in the approximately spherical air lamina. In a step of closing the valves, it is desirable that the air valve and the mixture suction valve shall be simultaneously closed.

As shown in the illustrated example, said valve means is included in a prior art engine which has the suction and exhaust valves disposed in V-formation, the valve positions of which are not changed. The valve means, therefore, can be an inexpensive device for a countermeasure against waste gas. Increase of manufacturing cost is minimized, and the combustion efficiency is improved.

Said mixture valve and air valve can be used without any change as a valve for enriched mixtures, and a thin mixture valve respectively according to their uses. Consequently, they can be a most useful valve means for use as a countermeasure against air pollution and for studying improvement of thermal efficiency.

Further, in the valve means shown in FIG. 1, if there problems remain in connection with ignition and a method for decreasing $NO_x$ based on the size or type of engine, an auxiliary combustion chamber may be constituted by the air valve as a countermeasure. In that case, the mixture valve is suitably shortened, as shown in FIG. 7, and a valve seat 700 adapted to the shortened member is mounted on the air valve, thereby to form a secondary combustion chamber 800. The countermeasure with oxidized nitrogen and ignition can accordingly be improved by the secondary chamber, without any trouble, by determining the length and position of the mixture valve. Furthermore, when the valve means are adopted as multi-use valves, the mixture is constituted with air and a solution of ammonia, alcohol and the like, amine and the like, ammonium and the like, sodium or potassium each dissolved in water or other solvent. As the other gas for the mixture there are selected steam, ammonia, alcohol and the like, hydrocarbon, oxygen, hydrogen etc., these being mainly used for controlling oxides of nitrogen.

The valve means according to this invention being adopted for multi-uses, as a countermeasure against $NO_x$, there are special methods of contact reduction and absorption, both using ammonia gas, ammonia water and alkaline water in addition to mixing of air.

Assuming that the nitrogen is oxidized in successive stages, e.g. $N_2O$ - NO - $NO_2$, the following formulae are obtained:

$$N_2 + \tfrac{1}{2}O_2 = N_2O,\ N_2O + \tfrac{1}{2}O_2 = 2NO,$$

and $$2NO + O_2 = 2NO_2.$$

Supposing that $NO_x$ is produced at any moment, $$N_2 + \tfrac{1}{2}O_2 = N_2O,\ N_2 + O_2 = 2NO,$$

and $$\tfrac{1}{2}N_2 + O_2 = NO_2.$$

These reactions are presumed to be physical chemistry reactions at high temperatures, so that heat and combustion velocity controlling and chemcial treatment appear to be performed simultaneously for controlling the waste gas.

First, the reaction of $NO_x$ and ammonia is shown as follows:

$$3N_2O + 2NH_3 \rightarrow 4N_2 + 3H_2O,$$

$$3NO + 2NH_3 \rightarrow 5/2N_2 + 3H_2O,$$

and $$3NO_2 + 4NH_3 \rightarrow 3\tfrac{1}{2}N_2 + 6H_2O.$$

Presuming that ammoniated nitric acid is produced, $$2NO_2 + 2NH_3 \rightarrow NH_4NO_3 + N_2 + H_2O,$$

$$2NO_2 + 2NH_4OH \rightarrow NH_4NO_2 + NH_4NO_3 + H_2O,$$

and $$NO + NO_2 + 2NH_4OH \rightarrow 2NH_4NO_2 + H_2O.$$

An absorption method using sodium or potassium is shown as follows:

$$4NO + 2NaOH \rightarrow N_2O + 2NaNO_2 + H_2O,$$

$$6NO + 4NaOH \rightarrow N_2 + 4NaNO_2 + H_2O,$$

and $$2NO_2 + 2NaOH \rightarrow NaNO_2 + NaNO_3 + H_2O.$$

Reaction of $NO_x$ and Hydrogen produced by decomposition of ammonia or hydrocarbon is as follows:

$$2NO + 5H_2 \rightarrow 2NH_3 + 2H_2O,$$

$$NO + H_2 \rightarrow \tfrac{1}{2}N_2 + {}_{H2}O,$$

$$NO_2 + 3\tfrac{1}{2}H_2 \rightarrow NH_3 + 2H_2O,$$

and $$NO_2 + 2H_2 \rightarrow \tfrac{1}{2}N_2 + 2H_2O.$$

Reaction of waste gas and ammonia is $$1\tfrac{1}{2}O_2 + 2NH_3 \rightarrow N_2 + 3H_2O,$$

and $$H.CHO + 2NH_3 \rightarrow N_2 + CH_4 + H_2 + H_2O.$$

These reactions are effected simultaneously. In oxidization, if any chemical agents are decomposed by the combustion, controlling $NO_x$ has no effect. Adding appropriate agents to $H_2O$ then prevents the decomposition of the agents by the combustion temperature. It is intended to control the temperature by water and prevent the decomposition of the agents.

In that case, a great deal of vaporized water or atomized water, including an agent which makes the vaporizing efficiency high, is sucked through a suction valve for multiple uses. This is intended to utilize a part of the steam pressure to give torque in the engine. The high pressure steam is produced in the cylinder by the heat of combustion of fuel from a great deal of evaporated water which is sucked into the fuel, such as hydrocarbon or especially hydrogen, acetylene etc., the combustion temperatures of which are very high. The multi-use valve may be the most appropriate device as a valve of such internal combustion steam engine.

I claim:

1. In a 4-stroke internal combustion engine, in combination:

(i) a cylinder structure having a cylindrical inner wall surface bounding a combustion chamber, said structure having a head at an end of said inner wall surface, said head including a fuel-air mixture inlet port and an exhaust gas outlet port both spaced radially inwards from the cylindrical inner wall, said head further including an annular air entry port opening into said combustion chamber between (a) the cylindrical inner wall and (b) the inlet and outlet ports (ii) a fuel-air mixture inlet valve member positioned in and movable to open and close said fuel-air mixture inlet portion (iii) an exhaust gas outlet valve member positioned in and movable to open and close said exhaust gas outlet port (iv) an annular air entry valve member positioned in and movable to open and close said air entry port.

2. A 4-stroke internal combustion engine, as claimed in claim 1, wherein said exhaust gas outlet member includes a second air entry port, and wherein a second air entry valve member is positioned in and is movable to open and close said second air entry port.

3. A 4-stroke internal combustion engine, as claimed in claim 1, wherein an igniter device is positioned with the mixture inlet valve and the exhaust gas outlet valve, at a spacing within the annular air entry valve.

* * * * *